US008182241B2

(12) United States Patent
Fulmer

(10) Patent No.: US 8,182,241 B2
(45) Date of Patent: May 22, 2012

(54) PERISTALTIC PUMPING MECHANISM HAVING A REMOVABLE COVER AND REPLACEABLE TUBING, ROLLERS AND PUMPING MECHANISM

(75) Inventor: Frederick J. Fulmer, Jacksonville, FL (US)

(73) Assignee: G.H. Stenner & Co., Inc.

( * ) Notice: Subject to any disclaimer, the term of this patent is extended or adjusted under 35 U.S.C. 154(b) by 955 days.

(21) Appl. No.: 11/608,831

(22) Filed: Dec. 10, 2006

(65) Prior Publication Data

US 2007/0140880 A1 Jun. 21, 2007

Related U.S. Application Data

(60) Provisional application No. 60/597,799, filed on Dec. 20, 2005.

(51) Int. Cl.
*F04B 17/00* (2006.01)
*F04B 43/12* (2006.01)

(52) U.S. Cl. ..... 417/360; 417/477.1

(58) Field of Classification Search ..... 417/360, 417/477.1

See application file for complete search history.

(56) References Cited

U.S. PATENT DOCUMENTS

| | | | | |
|---|---|---|---|---|
| 3,175,507 | A * | 3/1965 | Rydberg | 417/477.1 |
| 4,138,205 | A | 2/1979 | Wallach | |
| 4,239,464 | A | 12/1980 | Hein | |
| 4,798,580 | A * | 1/1989 | DeMeo et al. | 604/30 |
| 5,017,059 | A | 5/1991 | Davis | |
| 5,433,588 | A * | 7/1995 | Monk et al. | 417/477.2 |
| 5,927,956 | A * | 7/1999 | Lim et al. | 417/477.13 |
| 6,041,709 | A * | 3/2000 | Wells et al. | 101/366 |
| 6,688,858 | B1 * | 2/2004 | Boone et al. | 417/360 |
| 6,869,425 | B2 * | 3/2005 | Briggs et al. | 604/500 |

* cited by examiner

*Primary Examiner* — Charles G Freay
(74) *Attorney, Agent, or Firm* — Mark Young

(57) ABSTRACT

A peristaltic pump includes a pumping mechanism cover releasably coupled to a pumping mechanism base or gear case cover and configured to enshroud components including a roller assembly and tube. Removal of the pumping mechanism cover exposes the components to facilitate maintenance. The pumping mechanism cover may be locked into a closed position using a threaded bushing or a pivoting latch. A plurality of engagement studs may be provided to secure the pumping mechanism base to the gear case housing cover. The pumping mechanism base or gear case cover is configured for releasably engaging tubing inlet and outlet fittings. Thus, tubing may be installed or removed without having to disassemble or remove any other portion of the pumping mechanism base.

4 Claims, 6 Drawing Sheets

PERISTALTIC PUMPING MECHANISM HAVING A REMOVABLE COVER AND REPLACEABLE TUBING, ROLLERS AND PUMPING MECHANISM

RELATED APPLICATION

This application claims the benefit of priority of U.S. Provisional Application 60/597,799, filed Dec. 20, 2005, the entire contents of which are incorporated herein.

FIELD OF THE INVENTION

This invention generally relates to peristaltic pumps, and, more particularly, to a peristaltic pumping mechanism that includes a removable cover configured to facilitate access to a replaceable tubing and rollers.

BACKGROUND

A typical peristaltic pump includes a compressible tube for carrying a fluid. The tube generally has an upstream inlet, a downstream outlet and a curved portion oriented in a horseshoe-like or circular path. The curved portion is typically supported on its outermost surface against a curved stationary surface such as the interior wall of an enclosure for the pump. Near the upstream inlet, a rotor-mounted (or cage-mounted) roller engages and progressively squeezes the tube against the surface. The squeezing force is of sufficient magnitude to at least partially compress and generally occlude the internal passage of the tube. This occlusion is carried around the curved portion by the roller, forcing fluid ahead of the occlusion toward the downstream outlet portion of the tube. As fluid ahead of the occlusion is discharged through the downstream outlet, the expansion or restitution of the tube in the wake of the occlusion creates a suction that draws in more fluid through the upstream inlet, and the cycle repeats.

The unique pumping properties of peristaltic pumps make them ideally suited for certain applications. For example, peristaltic pumps are widely used in applications where constant metering of fluids at relatively low flow rates is desired; applications requiring the fluids being pumped to remain free of contamination; applications requiring the fluid path to remain clean or sterile; and applications where corrosive, caustic or hazardous fluids must be pumped without the fluid directly contacting any components of the pump mechanism other than the tubing. Despite these advantages, conventional peristaltic pumps suffer drawbacks, one being complexity of the pumping mechanisms with many separate parts and attendant difficulty in replacing tubing.

The tubing is an expendable component. Due to contamination and/or wear and tear during normal use, the tubing is typically replaced several times over the life of a pump. In applications requiring sterility, the tubing may be replaced after each use. Unfortunately, replacement of tubing in conventional pumps can be a time-consuming and frustrating task that is highly conducive to error. Typically, the replacement process entails removal of screws that secure a front panel of a housing, removal of the housing, removal of the old tubing and careful installation of a new tubing. While each of these steps may present difficulty and consumes considerable effort and time, the step of installing the new tubing is usually the most difficult and fraught with risk. The new tubing must be properly aligned within a narrow space between compression rollers and a housing wall. Typically, this space is extremely difficult to access. Excessive stretching or improper alignment of the tubing risks premature failure of the tubing. Likewise, ramming the tubing into the narrow space using a screwdriver or other tool risks physical damage compromising the structural integrity of the tubing.

An entire pumping mechanism or rollers may also require replacement periodically for maintenance or to accommodate a specific pumping application. Illustratively, a roller may fail due to normal wear and tear over time. As another example, a rotor having three rollers may need to be replaced with a roller having two rollers to achieve a determined pumping rate. Unfortunately, however, conventional peristaltic pumps do not facilitate tool-free access to, removal and replacement of rollers or an entire pumping mechanism. Instead, such tasks typically require use of one or more tools, handling of small loose fastening parts (e.g., snap rings, nuts, bolts, screws and the like), and a considerable investment of time and attention. Loss of any part or lack of a required tool precludes or delays the necessary maintenance.

Thus, a peristaltic pumping mechanism is needed that greatly facilitates replacement of tubing, and/or replacement of rollers, and/or replacement of an entire pumping mechanism, without tools and without loose small parts. The tubing and roller locations should be easy to access for removal and installation. The housing for the pumping mechanism should be configured for readily opening and securely closing without the need for tools. Once the housing is opened, the tubing and rollers should be readily removable without the need to remove other components of the pumping mechanism. Concomitantly, the entire pumping mechanism should be easily replaceable, without a need for tools.

Accordingly, a need exists for a peristaltic pump having a pumping mechanism that includes an improved removable cover configured to facilitate access to a replaceable tubing and rollers, wherein the entire pumping mechanism, rollers and tubing may be replaced without use of tools and without a plurality of small loose parts. The invention is directed to overcoming one or more of the problems and solving one or more of the needs as set forth above.

SUMMARY OF THE INVENTION

In one aspect of the invention, an exemplary peristaltic pumping mechanism includes a removable tubing assembly and a removable roller assembly. A pumping mechanism base is configured for releasable coupling to a gear case housing. A pumping mechanism cover is releasably coupled and in operable alignment to the pumping mechanism base. A threaded bushing is operably coupled to the pumping mechanism base by a hinged latch. The pumping mechanism cover includes a threaded hole for threadedly receiving the threaded bushing. The pumping mechanism cover is configured to enshroud the removable tubing and roller assemblies.

In another exemplary embodiment, the peristaltic pumping mechanism includes a gear case cover, a removable tubing assembly and a removable roller assembly, a pumping mechanism cover releasably coupled in operable alignment to the gear case cover, and a pivot pin and a pivoting latch operably coupled to the gear case cover by the pivot pin. The pumping mechanism cover includes a pair of parallel flanges. The pumping mechanism base includes a pair of parallel slots configured to slidingly receive the pair of parallel flanges of the pumping mechanism cover. The pivoting latch is operably configured to releasably lock the pumping mechanism cover to the gear case cover. The pumping mechanism cover is configured to enshroud the removable tubing and roller assemblies.

In another aspect of an exemplary implementation of the invention, the pumping mechanism cover includes a pair of parallel flanges, and the pumping mechanism base includes a pair of parallel slots configured to slidingly receive the pair of parallel flanges of the pumping mechanism cover.

In another aspect of an exemplary implementation of the invention, the hinged latch comprises a hinged latch base having distal and proximal ends and a lever having first and second ends. The hinged latch base is hingedly coupled to the pumping mechanism base at the distal end of the hinged latch base. The first end of the lever is hingedly attached to the proximal end of the hinged latch base. The threaded bushing is operably coupled to the second end of the lever.

In another aspect of an exemplary implementation of the invention, the tubing assembly comprises a tube having an inlet fitting at one end and an outlet fitting at an opposite end. The pumping mechanism base is configured to releasably engage the tubing inlet and outlet fittings.

In another aspect of an exemplary implementation of the invention, the gear case housing includes a plurality of mechanical attachment elements adapted for releasable attachment of the pumping mechanism base, and the pumping mechanism base includes a plurality of corresponding attachment elements adapted to releasably engage the mechanical attachment elements of the gear case housing.

In another aspect of an exemplary implementation of the invention, the gear case housing includes a plurality of studs adapted for releasable attachment of the pumping mechanism base, and the pumping mechanism base includes a plurality of corresponding tapered arcuate apertures adapted to releasably engage the plurality of studs of the gear case housing upon insertion of the studs into the tapered arcuate apertures and rotation of the pumping mechanism base relative to the gear case housing.

In another aspect of an exemplary implementation of the invention, a drive shaft is provided with a free end extending from the gear case housing through the pumping mechanism base. The roller assembly includes a spinner and at least one roller rotatably mounted along the periphery of the spinner. The spinner has a central aperture adapted to operably, slidingly, releasably engage the free end of the drive shaft. The pumping mechanism cover is configured to removably cover the free end of the drive shaft and the roller assembly engaged thereon.

In another aspect of an exemplary implementation of the invention, the drive shaft has a keyed free end and the spinner having a central aperture configured to securely releasably engage the keyed free end of the drive shaft.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale. The invention is not limited to the exemplary embodiments depicted in the figures or the shapes, relative sizes, proportions or materials shown in the figures.

DETAILED DESCRIPTION

The invention provides a peristaltic pumping mechanism that greatly facilitates replacement of tubing, rollers and the entire pumping mechanism. The tubing and roller locations are easy to access for removal and installation. The housing for the pumping mechanism may be readily opened without using any tools and without handling small loose parts. Once the housing is opened, the tubing and/or rollers may readily be removed, without the need to remove other components of the pumping mechanism.

Figure 1:
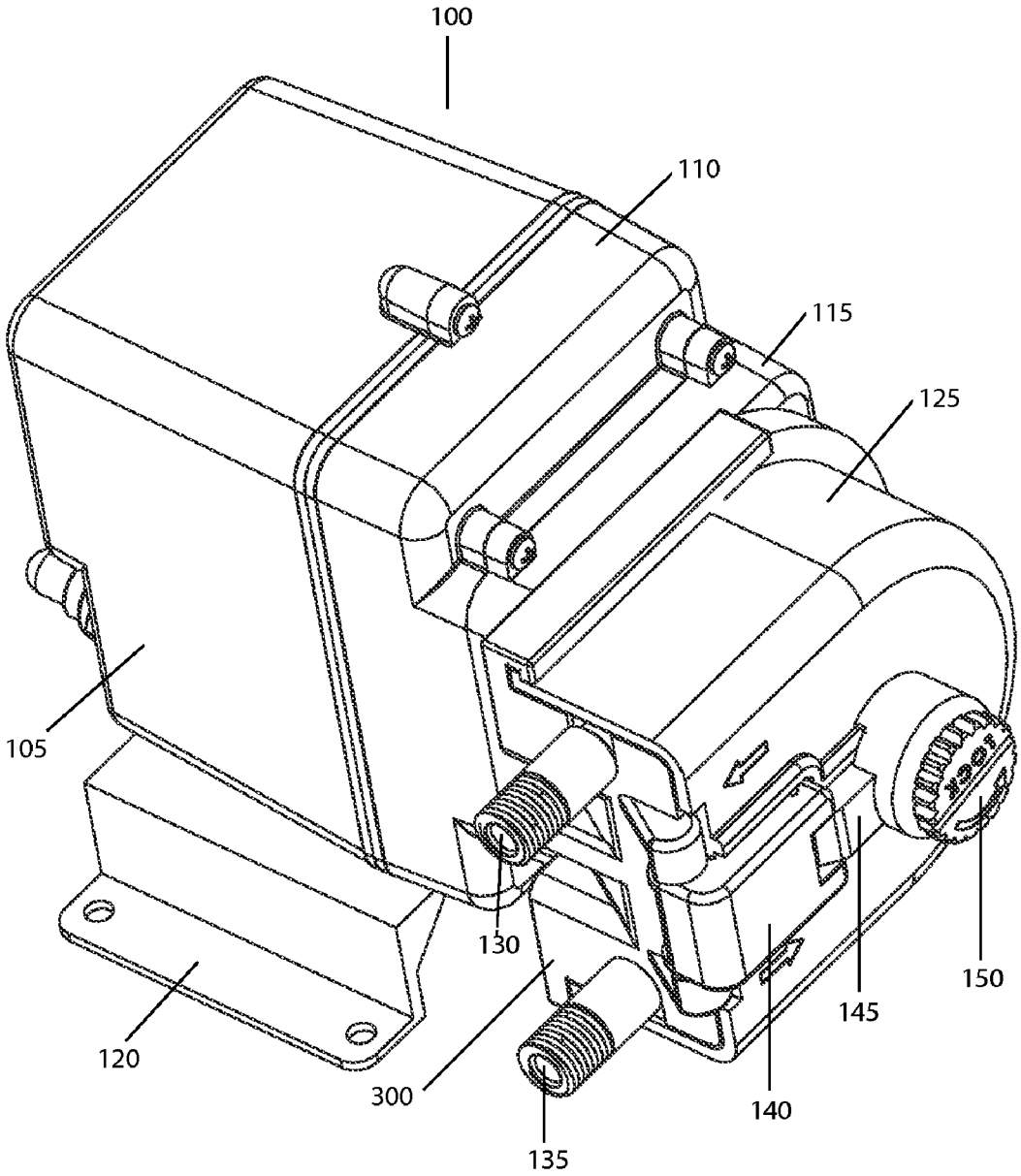
FIG. 1 is a perspective view of an exemplary assembled peristaltic pump according to principles of the invention.

Referring to FIG. 1, a perspective view of an exemplary assembled peristaltic pump 100 according to principles of the invention is conceptually illustrated. The pump 100 includes a motor housing 105 operably coupled to a gear case housing 110. A pumping mechanism cover 125, which is releasably coupled to a pumping mechanism base 300, enshrouds components comprising a peristaltic pumping mechanism. Removal of the cover 125 exposes the components to facilitate maintenance. A threaded bushing 150, which is hingedly coupled to the pumping mechanism base 300 by a hinged latch base 140 and lever 145, is configured to releasably engage the pumping mechanism cover 125.

Figure 2:
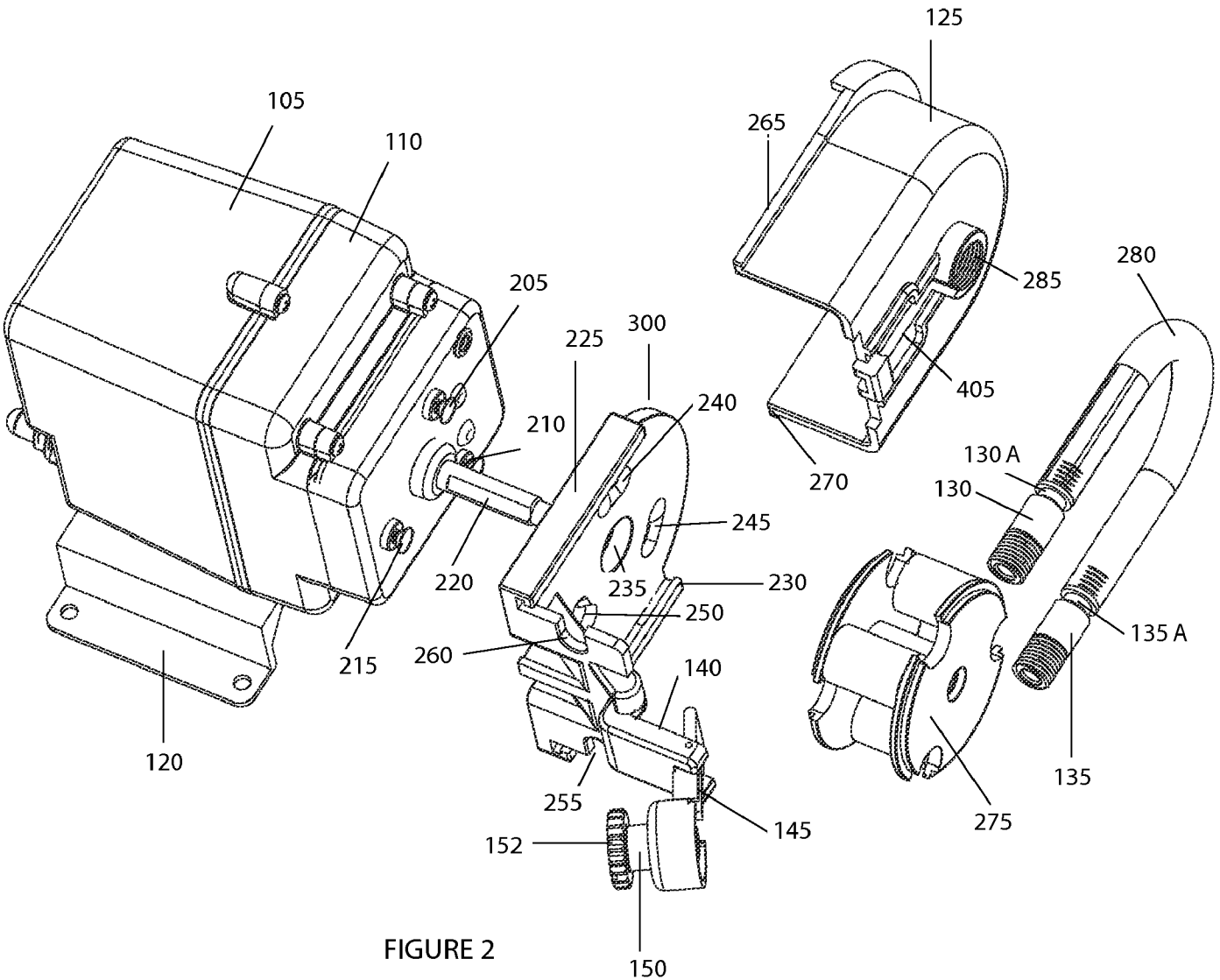
FIG. 2 is a perspective exploded view of an exemplary peristaltic pump according to principles of the invention.

Referring now to FIG. 2, a perspective exploded view of the exemplary peristaltic pump 100 according to principles of the invention is shown. A plurality of cleats or studs 205-215 protrude from the gear case housing cover 115. Corresponding tapered slots 240-250 are formed in the pumping mechanism base 300. The tapered slots 240-250 are arcuate slots, each having a narrow engagement end and a wide disengagement end. The free ends of the protruding studs may enter the slots 240-250 at the wide ends. A slight rotation of the pumping mechanism base 300 relative to the gear case housing cover 115 urges the studs 205-215 to the narrow engagement end of the slots. Thus, the studs 205-215 may be positioned to releasably engage the slots 240-250 for purposes of releasably securing the pumping mechanism base 300 to the gear case housing cover 115.

The exemplary pumping mechanism includes a rotor or spinner with rollers 275 configured to receive the free end of a keyed drive shaft 220. The keyed drive shaft 220 passes through a central drive shaft aperture 235 formed in the pumping mechanism base 300. The pumping mechanism base 125 constrains the spinner to the drive shaft when the base 125 is in a closed position. In operation, rotation of the drive shaft 220 causes the spinner with rollers 275 to rotate. The rollers engage and progressively squeeze the tube 280 against the surface of the pumping mechanism cover 125. The squeezing force is of sufficient magnitude to at least partially compress and generally occlude the internal passage of the tube 280. The occlusion is carried around the curved portion of the tube 280 by the rollers, forcing fluid ahead of the occlusion toward the downstream outlet portion of the tube 130. As fluid ahead of the occlusion is discharged through the downstream outlet 130, the expansion or restitution of the tube 280 in the wake of the occlusion creates a suction that draws in more fluid through the upstream inlet 135, and the cycle repeats.

The exemplary pumping mechanism cover 125 is configured for slidably engaging the pumping mechanism base 300. Illustratively, a pair of parallel channels 225, 230 are formed along opposite flanged edges of the pumping mechanism base 300. A pair of flanges 265, 270 in the pumping mechanism cover 125 are configured to fit into the channels 225, 230. Thus, the pumping mechanism cover 125 may be slid into a closed position relative to the pumping mechanism base 300 (as shown in FIG. 1), or slid to an open position for separation from the pumping mechanism base 300 (as shown in FIG. 2).

Figure 3:
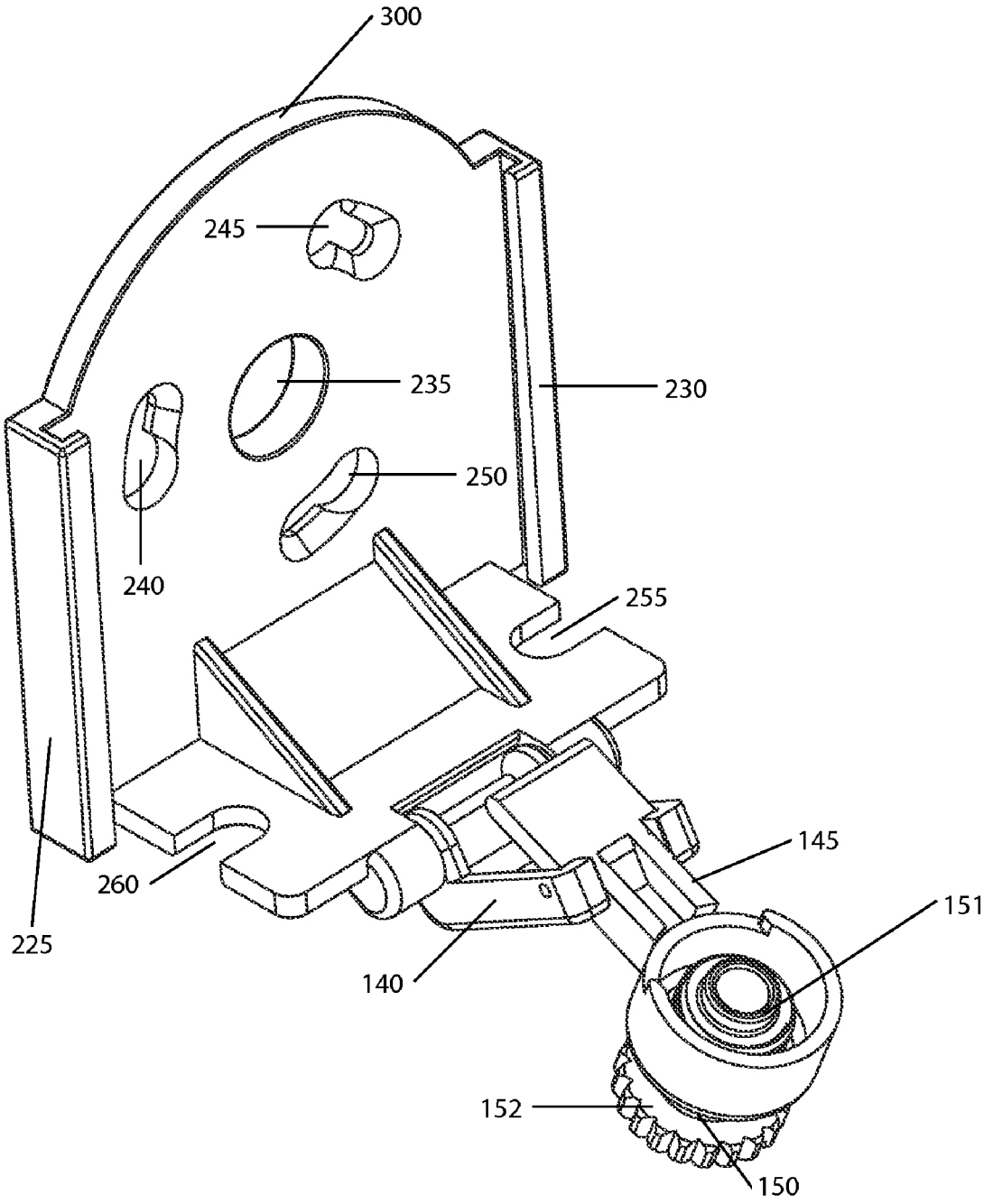
FIG. 3 is a perspective view of an exemplary pumping mechanism base for use in an exemplary peristaltic pump according to principles of the invention.
Figure 4:
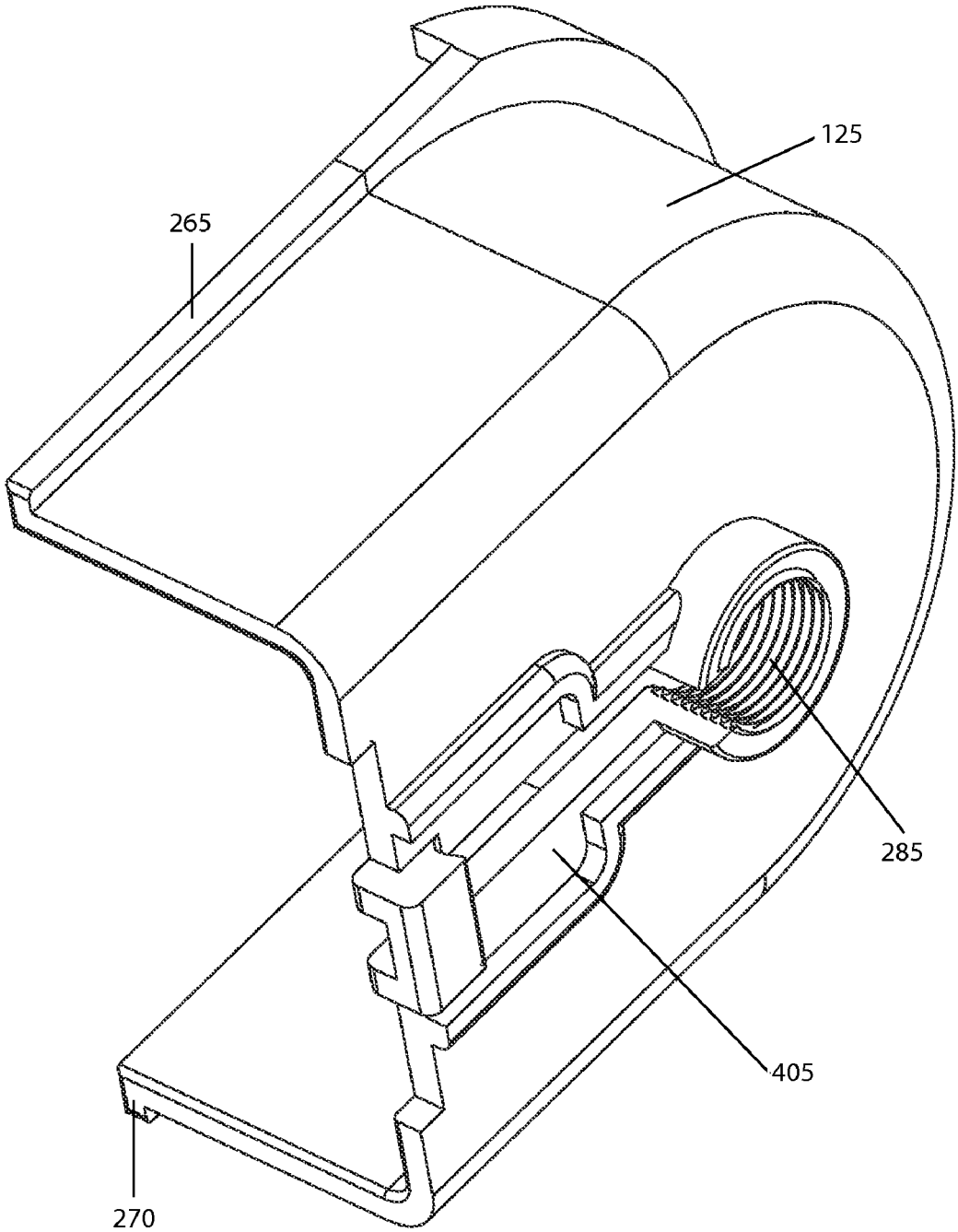
FIG. 4 is a perspective view of an exemplary pumping mechanism cover for use in an exemplary peristaltic pump according to principles of the invention.

A bushing 150 is provided to lock the pumping mechanism cover 125 into place when it is slid into a closed position relative to the pumping mechanism base 300. The bushing 150 includes a threaded end 151 (as shown in FIG. 3) and a finger grip 152. A hinged latch base 140 and hinged latch lever 145 flexibly couple the bushing 150 to the pumping mechanism base 300. Optionally, as shown in FIG. 4, the pumping mechanism cover 125 includes a recess for configured to releasably engage or receive the hinged latch base 140 and hinged latch lever 145 when the pumping mechanism cover 125 is locked into place. After the pumping mechanism cover 125 is slid into a closed position relative to the pumping mechanism base 300, the bushing may be threadedly screwed into a corresponding threaded hole 285 in the pumping mechanism cover 125, thereby releasably locking the pumping mechanism cover 125 to the pumping mechanism base 300, as illustrated in FIG. 1. To separate the pumping mechanism cover 125 from the pumping mechanism base 300, the bushing 150 may be manually loosened and removed from the threaded hole 285, without any tools. The loosened bushing 150 remains hingedly coupled to the pumping mechanism base 300.

The pumping mechanism base 300 is configured for releasably engaging the tubing inlet and outlet fittings 130, 135. The fittings 130, 135 include circumferential recesses 130A, 135A. Tubing engagement slots 255, 260 formed in the pumping mechanism base 300 are configured to slidably receive the circumferential recessed portions 130A, 135A of the fittings 130, 135. Thus, the tubing 280 may be releasably slid into the channels 225, 260 and removed from the channels 225, 260. As the slots are integral parts of the pumping mechanism base 300, the tubing 280 may be installed or removed without having to disassemble or remove any other portion of the pumping mechanism base 300.

Figure 5:
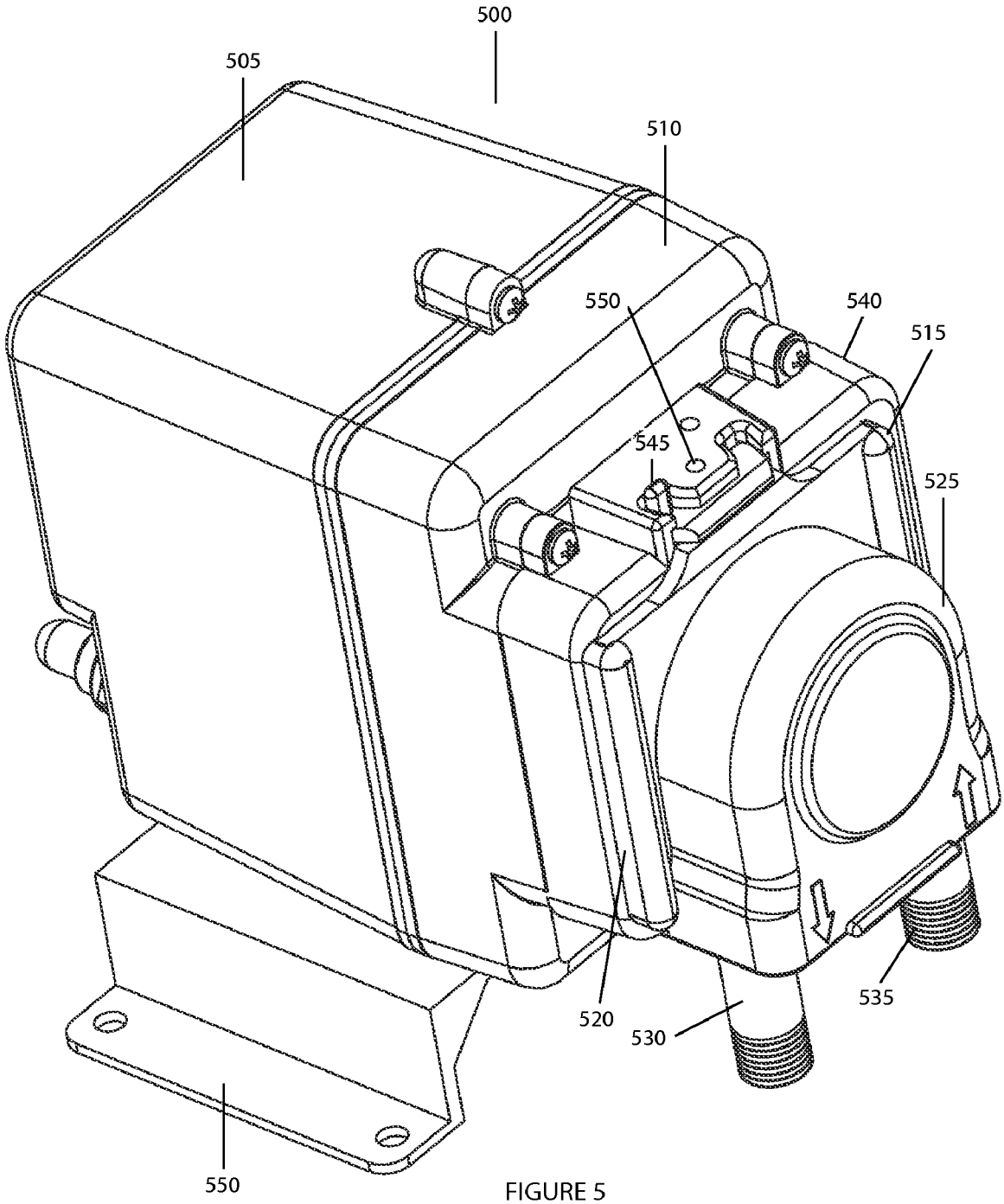
FIG. 5 is a perspective view of an alternative exemplary assembled peristaltic pump according to principles of the invention.

Referring now to FIG. 5, a perspective view of an exemplary alternative assembled peristaltic pump 500 according to principles of the invention is conceptually illustrated. The pump 500 includes a motor housing 505 operably coupled to a gear case housing 510. A pumping mechanism cover 525, which is releasably coupled to a gear case cover 540, enshrouds components comprising a peristaltic pumping mechanism. A pivoting latch 545, which is operably coupled to the gear case cover 540 by a pivot pin 550, is configured to pivotally engage the pumping mechanism cover 525.

Figure 6:
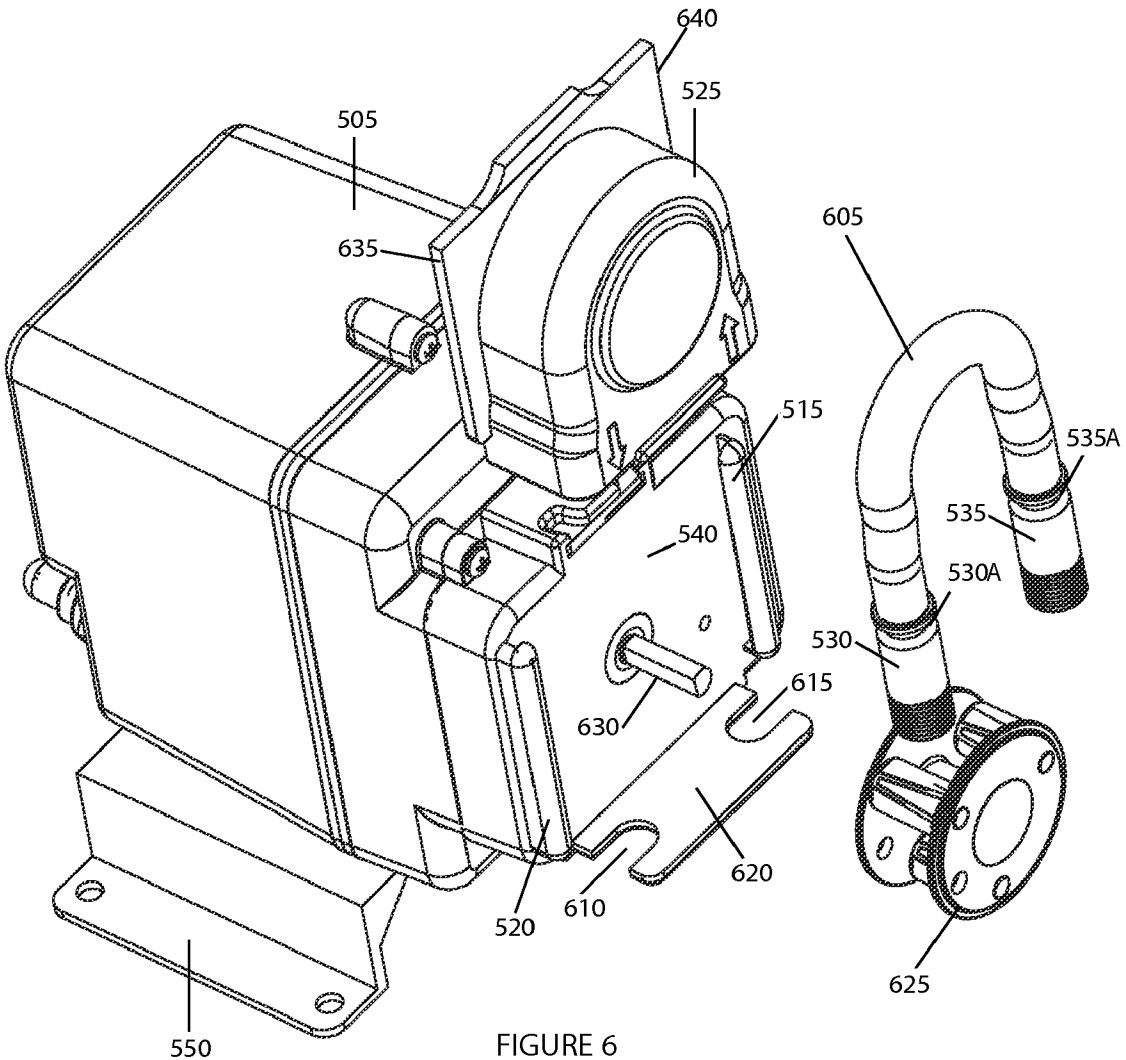
FIG. 6 is a perspective exploded view of an alternative exemplary peristaltic pump according to principles of the invention.

Referring now to FIG. 6, a perspective exploded view of the exemplary alternative peristaltic pump 500 according to principles of the invention is shown. As can be seen in FIG. 5, the pumping mechanism cover 525 is configured to be secured directly to the gear case cover 540.

The exemplary pumping mechanism includes a spinner with rollers 625 configured to receive the free end of a keyed drive shaft 630. In operation, rotation of the drive shaft 630 causes the spinner with rollers 625 to rotate. The rollers engage and progressively squeeze the tube 605 against the surface of the pumping mechanism cover 525. The squeezing force is of sufficient magnitude to at least partially compress and generally occlude the internal passage of the tube 605. This occlusion is carried around the curved portion of the tube 605 by the rollers, forcing fluid ahead of the occlusion toward the downstream outlet portion of the tube 530. As fluid ahead of the occlusion is discharged through the downstream outlet 530, the expansion or restitution of the tube 605 in the wake of the occlusion creates a suction that draws in more fluid through the upstream inlet 535, and the cycle repeats.

The exemplary pumping mechanism cover 525 is configured for slidably engaging the gear case cover 540. Illustratively, a pair of parallel channels 515, 520 are formed along opposite edges of the gear case cover 540. A pair of flanges 635, 640 in the pumping mechanism cover 525 are configured to fit into the channels 515, 520. Thus, the pumping mechanism cover 525 may be slid into a closed position relative to the gear case cover 540, or slid to an open position for separation from the gear case cover 540.

A pivoting latch 545 is provided to lock the pumping mechanism cover 525 into place when it is slid into a closed position relative to the gear case cover 540. After the pumping mechanism cover 525 is slid into a closed position relative to the gear case cover 540, the pivoting latch 545 may be pivoted from an open position as illustrated in FIG. 6 to a closed position as illustrated in FIG. 5, thereby releasably locking the pumping mechanism cover 525 to the gear case cover 540. To separate the pumping mechanism cover 525 from the gear case cover 540, the pivoting latch 545 may be manually pivoted from a closed position to an open position, without any tools.

The gear case cover 540 includes an integral tubing flange 620 configured for releasably engaging the tubing inlet and outlet fittings 530, 535. The fittings 530, 535 include circumferential recesses 530A, 535A. Tubing engagement slots 615, 610 formed in the tubing flange 620 are configured to slidably receive the circumferential recessed portions 530A, 535A of the fittings 530, 535. Thus, the tubing 605 may be releasably slid into the channels 520, 610 and removed from the channels 520, 610. As the slots are integral parts of the tubing flange 620, which is attached to the gear case cover 540, the tubing 605 may be installed or removed without having to disassemble or remove portions of the gear case cover 540.

While the invention has been described in terms of various embodiments, implementations and examples, those skilled in the art will recognize that the invention can be practiced with modification within the spirit and scope of the appended claims including equivalents thereof. The foregoing is considered as illustrative only of the principles of the invention. Variations and modifications may be affected within the scope and spirit of the invention.

What is claimed is:

1. A peristaltic pumping mechanism comprising:

a gear case cover including an integral tubing flange;

a removable tubing assembly and a removable roller assembly;

a pumping mechanism cover releasably coupled in operable alignment to the gear case cover;

a pivot pin and a pivoting latch operably coupled to the gear case cover by the pivot pin;

said pumping mechanism cover including a pair of parallel flanges;

said gear case cover including a pair of parallel slots having a first end and a second end, said pair of slots configured to slidingly receive the pair of parallel flanges of the pumping mechanism cover;

said pivoting latch being operably configured to releasably lock the pumping mechanism cover to the gear case cover and being located proximate the first end of the pair of slots;

said tubing flange being located proximate the second end of the pair of slots; and said pumping mechanism cover being configured to enshroud the removable tubing and roller assemblies.

2. A peristaltic pumping mechanism according to claim 1, wherein the integral tubing flange has a pair of tubing engagement slots, said tubing assembly comprises a tube having an inlet fitting at one end and an outlet fitting at an opposite end, said inlet fitting having a first circumferential recessed portion, said outlet fitting having a second circumferential recessed portion, said tubing engagement slots being configured to releasably engage the tubing inlet and outlet fittings by slidingly receiving the first and second circumferential recessed portions.

3. A peristaltic pumping mechanism according to claim 2, wherein the gear case housing includes a plurality of mechanical attachment elements adapted for releasable attachment of said gear case cover, and said gear case cover includes a plurality of corresponding attachment elements adapted to releasably engage the mechanical attachment elements of the gear case housing.

4. A peristaltic pumping mechanism according to claim 2, further comprising a drive shaft having a keyed free end extending from said gear case housing through said gear case cover;

said roller assembly comprising a spinner and at least one roller rotatably mounted along the periphery of the spinner;

said spinner having a central aperture configured to securely releasably engage said keyed free end of said drive shaft;

said central aperture being adapted to operably, slidingly, releasably engage said free end of said drive shaft; and said pumping mechanism cover being configured to removably cover said keyed free end of said drive shaft and said roller assembly engaged thereon, preventing removal of the roller assembly until the pumping mechanism cover is removed.

* * * * *